US006070024A

United States Patent [19]

Oono

[11] Patent Number: 6,070,024

[45] Date of Patent: May 30, 2000

[54] IMAGE FORMING APPARATUS

[75] Inventor: Michiteru Oono, Yokohama, Japan

[73] Assignee: Kabushiki Kaisha Toshiba, Kawasaki, Japan

[21] Appl. No.: 09/122,889

[22] Filed: Jul. 28, 1998

[30] Foreign Application Priority Data

Jul. 29, 1997 [JP] Japan ..... 9-203200

[51] Int. Cl.[7] ..... G03G 15/00

[52] U.S. Cl. ..... 399/66; 399/310; 399/311

[58] Field of Search ..... 399/66, 310, 311, 399/314, 315, 297, 316, 313

[56] References Cited

U.S. PATENT DOCUMENTS

| | | | |
|---|---|---|---|
| 4,190,348 | 2/1980 | Friday | 355/3 |
| 5,012,293 | 4/1991 | Aldrich et al. | 399/66 |
| 5,099,287 | 3/1992 | Sato | 399/66 |
| 5,225,879 | 7/1993 | Hayashida | 355/274 |
| 5,287,163 | 2/1994 | Miyashiro et al. | 399/66 |
| 5,541,718 | 7/1996 | Oono | 355/271 |
| 5,713,063 | 1/1998 | Oono | 399/66 |
| 5,884,121 | 3/1999 | Kyung | 399/66 |
| 5,978,618 | 11/1999 | Yamamoto et al. | 399/66 |

FOREIGN PATENT DOCUMENTS 57-210375 12/1982 Japan .

OTHER PUBLICATIONS

60–134264, Niro Masakazu, Transfer Device, Patent Abstracts of Japan, vol. 009, No. 299 (P–408), (1985), & JP 60 134264 A, (Ricoh KK), Jul. 17, 1985.

57–191670, Kitamura Takahiko, Transfer and Separating System, Patent Abstracts of Japan, Vol. 007, No. 038 (P176), (1983) & JP 57 191670 A (Ricoh KK), Nov. 25, 1982.

9–80936, Masaki Tokuhashi, Image Forming Device, Patent Abstracts of Japan vol. 097, No. 007, (1997) & JP 09 080936 A (Ricoh Co. Ltd), Mar. 28, 1997.

58–122561, Tetsuo Sakurai, Transferring Method of a Copying Machine, Patent Abstracts of Japan vol. 007, No. 234 (P 230), (1983), & JP 58 122561 A (Ricoh KK), Jul. 21, 1983.

59–206853, Otsuki Hajime, Transfer Device, Patent Abstracts of Japan, vol. 009, No. 076 (P346), (1985) & JP 59 206853 A (Minolta Camera KK), Nov. 22, 1984.

*Primary Examiner*—William Royer
*Assistant Examiner*—William A. Noē
*Attorney, Agent, or Firm*—Foley & Lardner

[57] ABSTRACT

A copier includes a transfer charger for electrostatically transferring a toner image which is formed on a surface of a photoelectric drum to a sheet and a separation charger for separating the sheet with a toner image transferred thereto from the drum surface. A transfer guide is provided on a conveying path upstream of the transfer charger to guide the sheet toward a transfer point provided relative to the photosensitive drum. A separation supporter for supporting the sheet is provided above the separation charger. A transfer output from the passing of a leading edge portion of the sheet through the transfer point to the supporting of it by the separation support is switched to a High level, a transfer output from the supporting of the leading edge portion of the sheet until just before the trailing edge of the sheet is moved away from the transfer guide is set to a Middle level, and a transfer output from the moving of the trailing edge portion of the sheet away from the transfer guide until it is passed through the transfer point is set to a Low level. By doing so it is possible to uniformly print a sheet from a leading edge to a trailing edge and form a better-quality image.

15 Claims, 4 Drawing Sheets

IMAGE FORMING APPARATUS

BACKGROUND OF THE INVENTION

1. Field of the Invention

The present invention relates to an image forming apparatus for forming a developing agent image on an image carrier and, by transferring the developing agent image on a transfer material, outputting the image onto the material and, in particular, to an image forming apparatus capable of effecting a transfer output switching in accordance with the conveying position of a transfer material.

2. Description of Related Art

A printer apparatus such as an electrophotographic copying apparatus or an electrostatic recording apparatus as for example disclosed in U.S. Pat. No. 5,225,879 has a transfer charger which is a DC corona discharger and a separation charger which is an AC corona discharger. The transfer charger and the separation charger are separated from a photoconductive drum which constitutes the image-bearing member. The transfer charger discharges a back surface of a paper sheet via the DC corona to electrostatically transfer a toner image from the photoconductive drum to the paper sheet. Then the separation charger discharges the paper sheet via the AC corona to electrostatically separate the paper sheet with the toner image from the photoconductive drum.

In the conventional printer apparatus of this type, when the sheet was passed through a transfer area between the drum surface and the respective charger, the outputs of the transfer charger and separation charger were controlled at all times to given levels.

By this method, in a state in which the sheet was supported by both a transfer guide provided upstream of the transfer charger and a separation supporter provided relative to the separation charger and intimately contacted with the drum surface, it was possible to obtain a better transfer process.

In the case where a sheet left in a high humidity environment for a longer period of time is passed through the transfer area, if the leading edge portion of the sheet is passed over from the transfer guide to the separation supporter, then the leading edge portion of the sheet is separated away from the drum surface due to a decrease in stiffness of the sheet, so that there occurs a partial loss in intimate contact between the drum surface and the sheet and hence an imperfect image transfer.

Further, if such partial loss in close contact between the sheet and the drum surface occurs due to a partial separation of the trailing edge of the sheet from the transfer guide, then the trailing edge portion of the sheet moves nearer the transfer charger and separation charger. Further, when the trailing edge of the sheet leaves the transfer guide, thus no longer contacting the surface of the drum, the trailing edge portion of the sheet bends down toward the transfer charger and the separation charger. Then, the trailing edge part of the sheet vibrates, due to influence by the corona charge applied from the transfer charger and the separation charger. Consequently, the toner particles move on the trailing edge portion of the sheet, inevitably jeopardizing the transfer of a toner image. This will ultimately deteriorate the resultant image, forming while spots, for example, in the image.

SUMMARY OF THE INVENTION

It is accordingly an object of the present invention to provide an image forming apparatus for electrostatically transferring a developing agent image which is formed on an image carrier onto a transfer material and, by doing so, outputting the image onto the material, which can uniformly transfer a developing agent image from a leading edge through to a trailing edge of the transfer material and create a better-quality image.

According to the present invention, there is provided an image forming apparatus for forming an image on a transfer material which is conveyed in a given direction and includes a leading edge portion, middle portion and trailing edge portion along that conveying direction, comprising:

developing agent image forming means for forming a developing agent image on an image carrier;

conveying means for conveying the transfer material in the given direction;

transfer means, for transferring the developing agent image on the image carrier to the material by supplying a transfer charge to the material conveyed by the conveying means; and control means for controlling a transfer charge amount supplied to the leading edge portion of the material to be a first charge amount and a transfer charge amount which supplied to the middle portion of the material to be a second charge amount smaller than the first charge amount.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments give below, serve to explain the principles of the invention.

DETAILED DESCRIPTION OF THE PREFERRED EMBODIMENTS

An embodiment of the present invention will be explained in more detail below with reference to the accompanying drawing.

Figure 1:
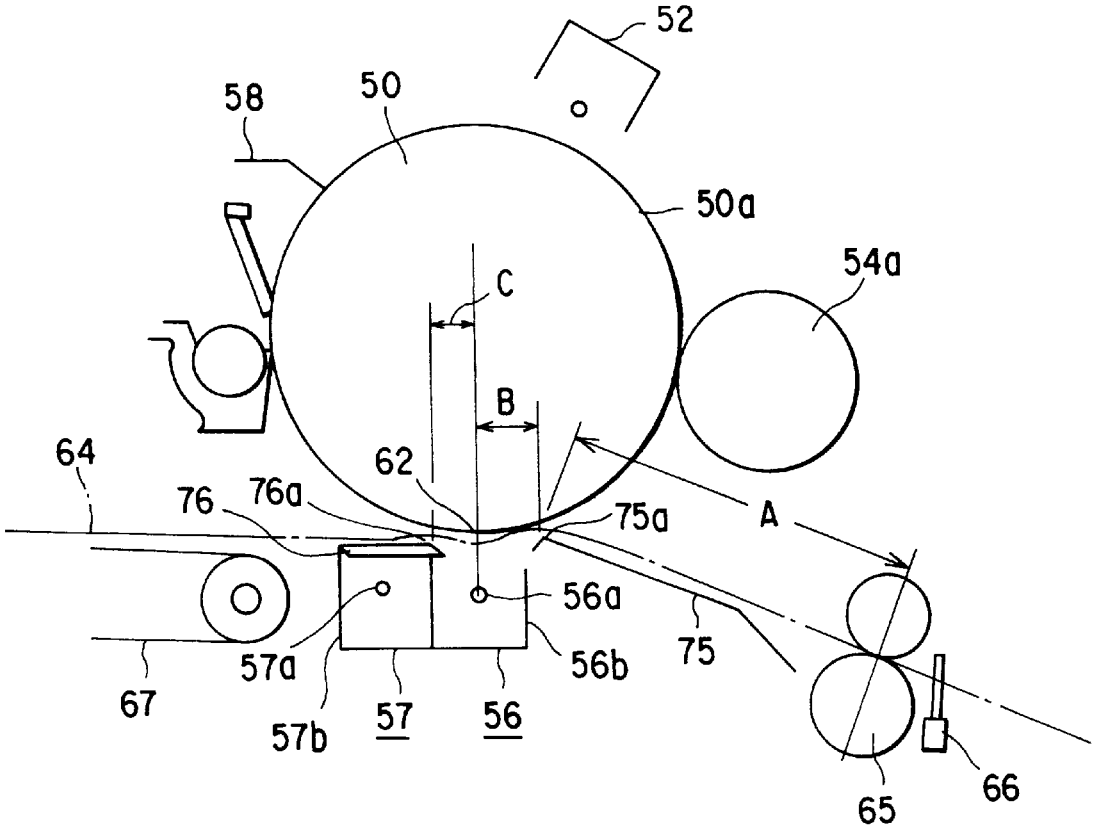
FIG. 1 is a diagrammatic view showing a main portion of an image forming apparatus according to an embodiment of the present invention.

FIG. 1 is a diagrammatic view showing a major section of an image forming apparatus of the present invention. Around a photosensitive drum 50 serving as an image carrier, a charger 52 is arranged to uniformly charge the photosensitive drum surface 50*a*. The drum surface 50*a* charged by the charger 52 is exposed, by a light exposure device not shown, to a beam corresponding to an image signal to form an electrostatically latent image thereon. A developing unit 54*a* for developing the electrostatically latent image is provided on a downstream side of the charger 52 along a moving direction of the photosensitive drum 50. A transfer unit 56 and separation unit 57 are arranged downstream of the developing unit 54*a*. A cleaning unit 58 is provided downstream of the transfer unit 56 and separation unit 57 and, after a developing agent image has been transferred by the transfer unit 56 from the drum surface 50*a* to a medium such as a sheet P, eliminates the developing agent image remaining on the drum surface 50*a*. The sheet P is sent by a pair of register rollers 65 onto the photosensitive drum in a predetermined timing, followed by the transferring of the developing agent image. The image-transferred sheet P, being separated from the drum surface 50*a*, is sent by a conveyor unit 67 onto a fixing unit not shown.

The above-mentioned transfer charger 56, separation charger 57 and associated surrounding members will be explained below with reference to FIG. 2.

The transfer charger 56 has a corona discharge wire 56*a* and its surrounding shield casing 56*b*. The separation charger 57 has a corona discharge wire 57*a* and its surrounding shield casing 57*b*. The shield casing 56*b* of the transfer charger 56 and shield casing 57*b* of the separation charger 57 are assembled into an integral structure with a partition section shared therebetween.

A transfer guide 75 is provided on the conveying path at a position upstream of the transfer charger 56, that is, on the entry side of the transfer charger 56 so as to guide the sheet P. A separation supporter 76 for guiding the sheet P is provided above the shield casing 57*b* of the separation charger 57 so as to close an upper opening of the separation charger 57. Thus, the sheet P is passed from the transfer guide 75 to the separation supporter 76 and conveyed in a state to be intimately contacted with the drum surface 50*a*.

It is to be noted that the transfer guide 75 and separation supporter 76 constitute, together with the above-mentioned register roller pair 65 and conveying unit 67, a conveying means for conveying the sheet P past the image transfer point 62.

Figure 2:
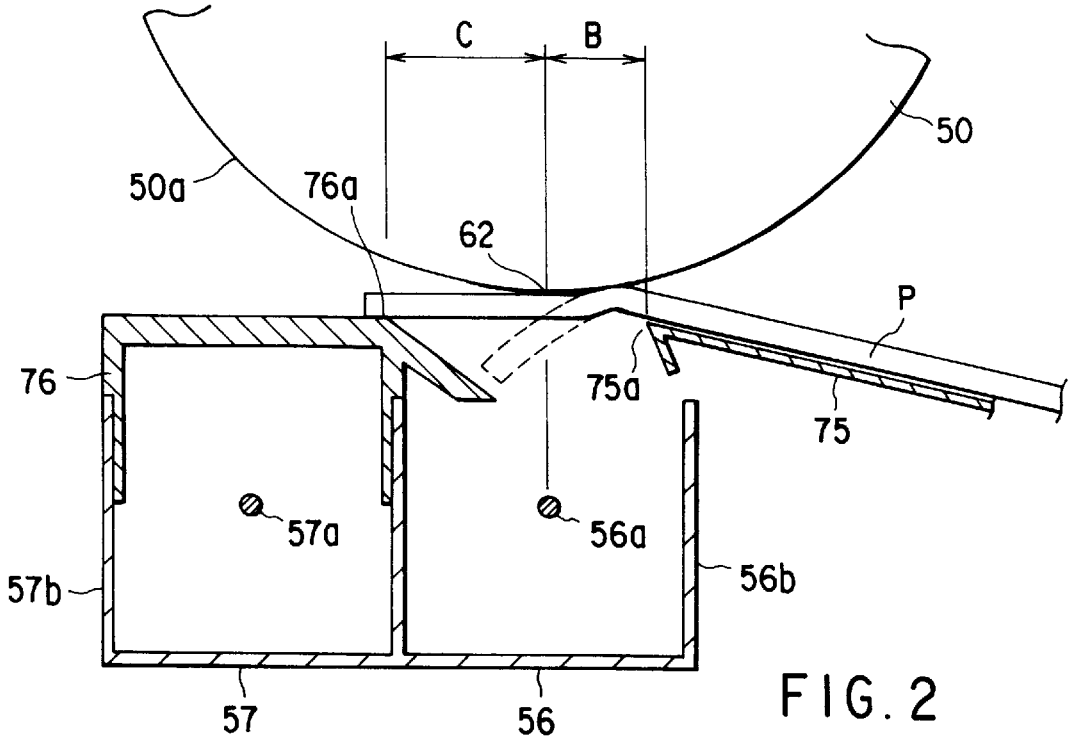
FIG. 2 is a cross-sectional view showing a transfer charger, separation charger and its surrounding structure incorporated into the copier of FIG. 1.

By such an arrangement with the sheet P supported by a forward end 75*a* of the transfer guide 75 and upper surface of the separation supporter 76, the sheet P is intimately contacted with the drum surface 50*a* as indicated by a solid line in FIG. 2. It is, therefore, possible to obtain a better image under a better transfer condition.

When the leading edge of the sheet P is occupied between the forward end 75*a* of the transfer guide 75 and an angled area 76*a* of the separation supporter 76 situated on the most upstream side, that is, the leading edge portion of the sheet P is placed in a not-supported state, a phenomenon, called "sagging", occurs at the leading edge portion of the sheet P as indicated by a dashed line in FIG. 2. This phenomenon is prominent, in particular, in a sheet P left under a high moisture environment for a longer period of time. At that place, a gap is created relative to the drum surface 50*a*, so that it impairs an intimate contact of the leading edge of the sheet P with the drum surface 50*a*. This causes imperfect image transfer.

Figure 3:
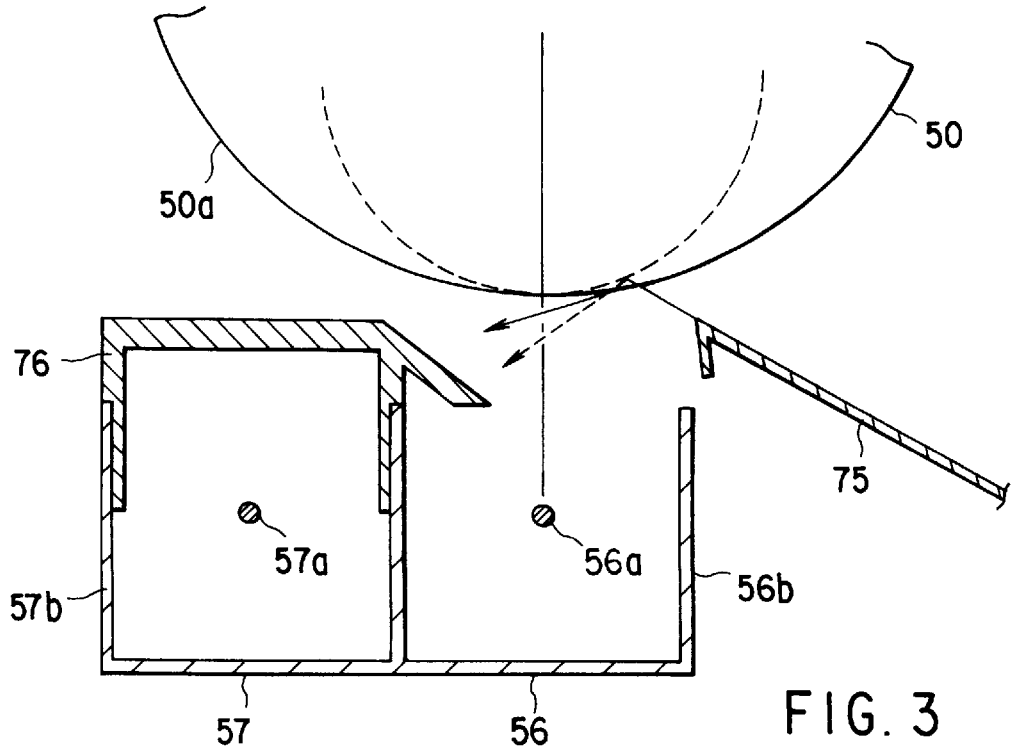
FIG. 3 is a view for explaining a change in abutting angle of a sheet against a drum surface when a diameter of a photosensitive drum is varied.

The transfer guide 75 for guiding the sheet P toward the image transfer point 62 is positioned in a state upwardly tilted toward the photosensitive drum 50 so that the leading edge of the guided sheet P may be advanced at a give angle toward the drum surface 50*a*. If, therefore, the diameter of the photosensitive drum 50 is smaller as indicated by the dash line in FIG. 3, the sheet P is advanced at an abrupt angle. If, therefore, the diameter of the photosensitive drum 50 is made smaller, then the leading edge of the sheet P is liable to be bent down upon abutting against the drum surface 50*a*, so that the leading edge portion of the sheet P sags.

Figure 4:
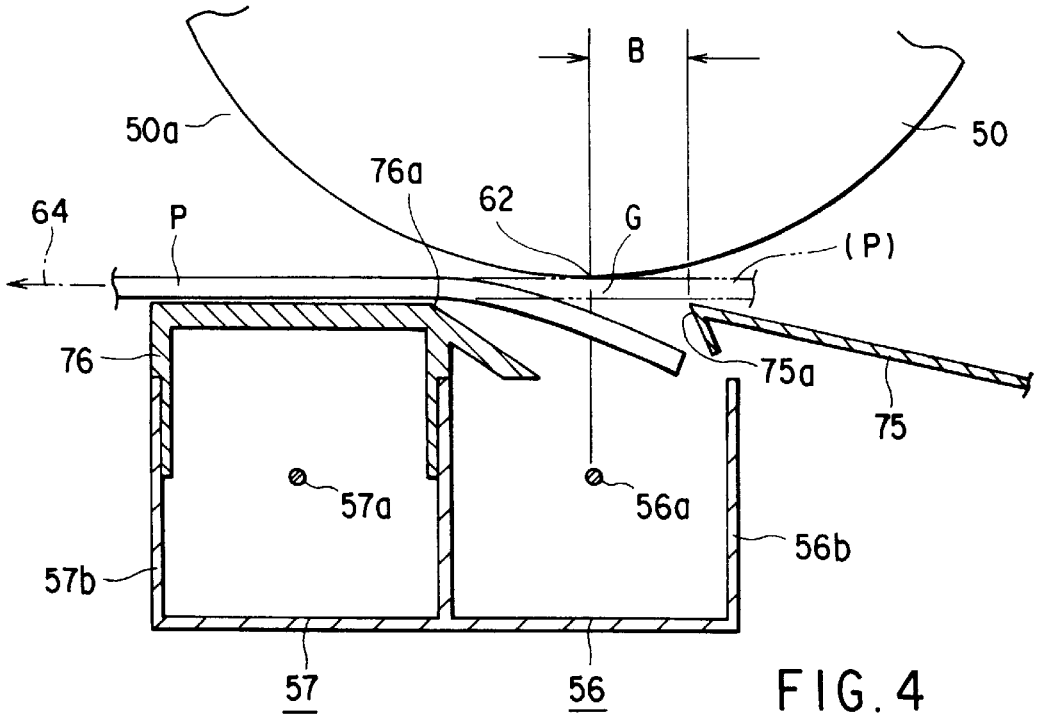
FIG. 4 is a view for explaining the behavior of a trailing edge of the sheet when the trailing edge portion of the sheet is passed between the transfer charger and the photosensitive drum.

When the sheet P is passed through the image transfer point 62 and, as shown in a solid line, the trailing edge portion of the sheet P is moved apart from a forward end 75*a* of the transfer guide 75, then the trailing edge portion of the sheet P sags under its own weight as shown in FIG. 4. At this time, a gap G is created between the trailing edge portion of the sheet P and the drum surface 50*a*. In this way, if intimate contact fails between the drum surface 50*a* and the trailing edge portion of the sheet P, an image imperfection occurs at the trailing edge portion of the sheet P corresponding to a width B between the corona discharge wire 56*a* of the transfer charger 56 and the forward end 75*a* of the transfer guide 75.

That is, as the leading or trailing edge portion of the sheet leaves the drum surface 50*a* and then bends down toward the top of the transfer charger 56 or approaches the separation charger 57, it vibrates, due to influence by the corona charge applied from the transfer charger and the separation charger. Consequently, the toner particles move on the edge portion of the sheet, inevitably jeopardizing the transfer of a toner image. This will ultimately deteriorate the resultant image, forming white spots, for example, in the image.

Figure 5:
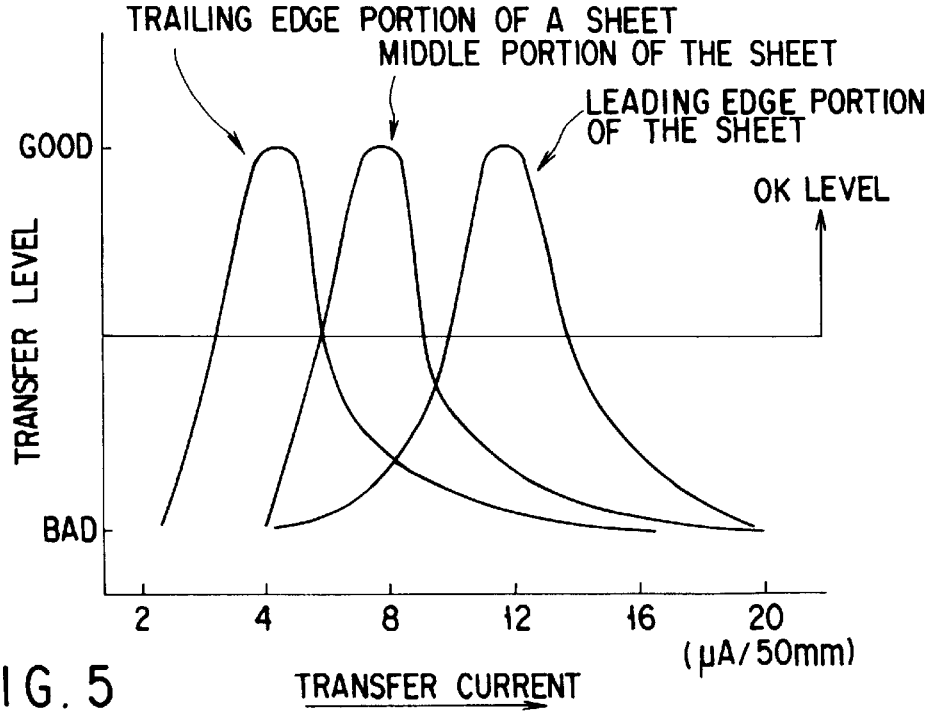
FIG. 5 is a graph showing a variation in transfer level against transfer outputs corresponding to a leading edge portion, middle portion and trailing edge portion of a sheet.

According to the present embodiment, therefore, in order to effect better transfer across the whole length of the sheet P, the outputs of the transfer-charger 56 and separation charger 57 are switched in accordance with the conveying position of the sheet P. In this connection, examination is made on a variation in transfer level when the output of the transfer varies at the leading edge portion, middle portion and trailing edge portion of the sheet as viewed along the sheet conveying direction. FIG. 5 shows a result of tests conducted.

From the graph of FIG. 5 it is found that, when the transfer output is set to about 6 to 9 $\mu$A (8 $\mu$A in particular), an adequate transfer level is reached at the middle of the sheet, that is, at the portion of the sheet P intimately contacted with the drum surface 50*a*.

For the leading edge section of the sheet P, on the other hand, the sheet P is not intimately contacted with the drum surface 50*a* due to the sagging of the leading edge portion of the sheet P and, in particular, image imperfection is liable to occur under a high humidity environment. In order to achieve an adequate transfer level, it is required that the leading edge portion of the sheet P be set to a high transfer output level (about 10 to 14 $\mu$A, in particular, 12 $\mu$A). For the trailing edge of the sheet, the sheet is not intimately contacted with the drum surface 50*a* and, under a low humidity environment, transfer spots or marks are liable to occur during the transfer process. In order to achieve an adequate transfer level, it is necessary to set the trailing edge of the sheet to a lower transfer output (about 3 to 6 $\mu$A, in particular, 4 $\mu$A) than the middle portion of the sheet.

Stated in another way, it is possible to achieve an adequate transfer level over a full length, and along the conveying direction, of the sheet P by setting the leading edge portion of the sheet to a relatively high transfer output of about 10 to 14 μA, the middle portion of the sheet to a transfer output of about 6 to 9 μA and the trailing edge portion of the sheet to a relatively low transfer output of about 3 to 6 μA. That is, it is possible to form an image of better quality over a full length of the sheet P by switching the transfer output in accordance with the conveying position of the sheet P.

Further, according to the present invention, at the time of the switching control of the transfer output with respect to the above-mentioned trailing edge portion of the sheet, the "separation" output by the separation charger 57 is also switched simultaneously. More specifically, the resistance of the sheet P is lower than is necessary when the ambient humidity is high. In this case, the separation charger 57 discharges a part of the charge applied on the sheet P at the image transfer point 62, in particular a part of the charge applied to the trailing edge portion of the sheet P. As a consequence, imperfect transfer of an image is liable to occur, particularly at the trailing edge portion of the sheet P. It is, therefore, necessary to, while effecting the switching control of the transfer output with respect to the sheet's trailing edge portion, switch the "separation" output to a level lower than the level maintained until then.

For the leading and trailing edge portions of the sheet, P as distinct from the middle portion of the sheet P, different proper values are necessary to achieve an adequate transfer level and, according to the present invention, it is possible to detect the size of a sheet P being conveyed, monitor the conveying position of the sheet P passing through the transfer/separation path on the basis of the result of the size detection and effect the switching control of the transfer output and "separation" output in accordance with the conveying position of the sheet P.

Figure 6:
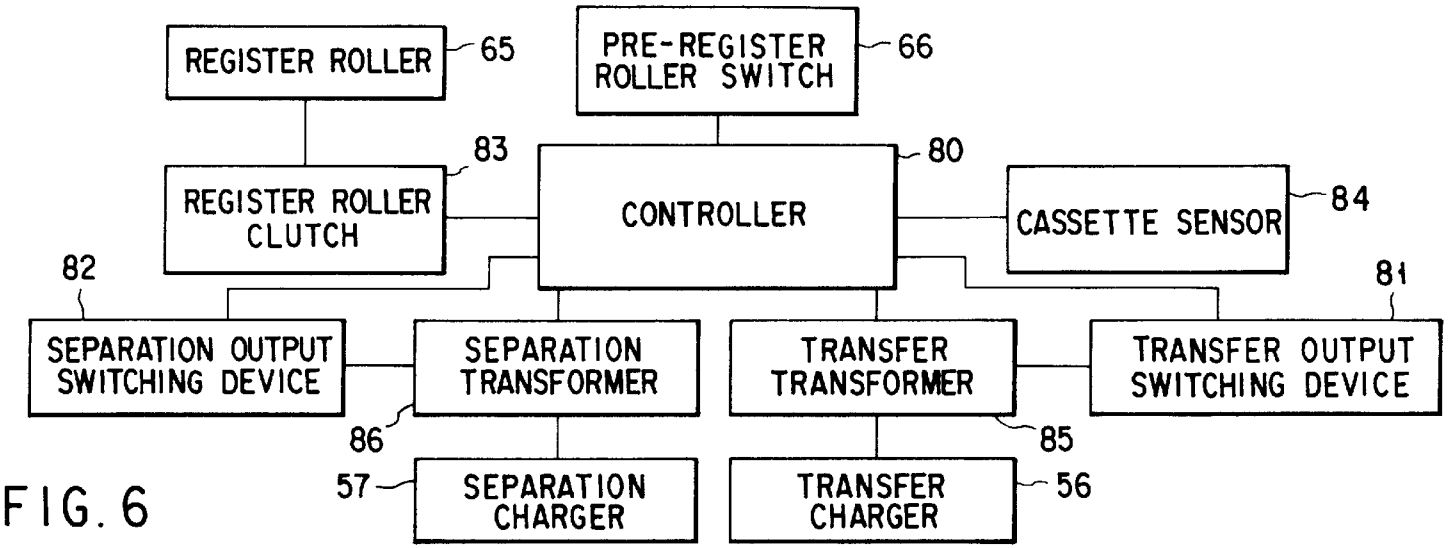
FIG. 6 is a block diagram showing a control system for effecting the output control of a transfer charger and separation charger.

FIG. 6 shows a block diagram showing a control system for switching the transfer output of the transfer charger 56 and "separation" output of the separation charger 57 in accordance with the conveying position of the sheet P.

A controller 80 includes a pre-register roller switch 66, a register roller clutch 83 for switching the rotation and stopping of the register roller pair 65, a cassette sensor 84 for detecting the size of the sheet P to be fed by detecting the sheet cassette not shown, a transfer transformer 85 comprised of a high voltage transformer for applying a DC voltage to the transfer charger 56, and a separation transformer 86 comprised of a high voltage transformer for applying a DC voltage and AC voltage to the separation charger 57. Further, a transfer output switching device 81 connected to the transfer transformer 85, as well as a separation output switching device 82 connected to the separation transformer 86, is connected to the controller 80.

Thus, the transfer output control by the transfer charger 56 is switched to a High level (12 μA) immediately before the leading edge of the sheet P reaches the image transfer point 62. When the leading edge of the sheet P reaches the angular area 76*a* of the separation supporter 76, the transfer output is switched from the High level (12 μA) to a Middle level (8 μA). Subsequently, immediately before the trailing edge of the sheet P is passed through the forward end 75*a* of the transfer guide 75, the transfer output is switched from the Middle level (8 μA) to a Low level (4 μA) and at a time when the trailing edge of the sheet P is passed through the image transfer point 62, the transfer output is turned OFF.

On the other hand, the "separation" output control by the separation charger 57 is switched simultaneously with the transfer output control by the trailing edge of the sheet P. That is, the "separation" output is switched from High (4.5 KV/200V) to Low (3 KV/0V) for the trailing edge of the sheet P, in the same way as the transfer output is switched for the trailing edge of the sheet P. Unlike the transfer output, however, the separation output remains ON even while the leading edge of a sheet P is approaching the separation point after the trailing edge of the preceding sheet P has left the separation point.

The switching control of the transfer output and "separation" output as set out above are repeated at each passage of the sheet P.

In this connection it is to be noted that the surface potential on the photosensitive drum 50 applied by the charging device 52 is set to −750V and a development bias on the developing roller 54*a* of the developing device is set to −500V.

Figure 7:
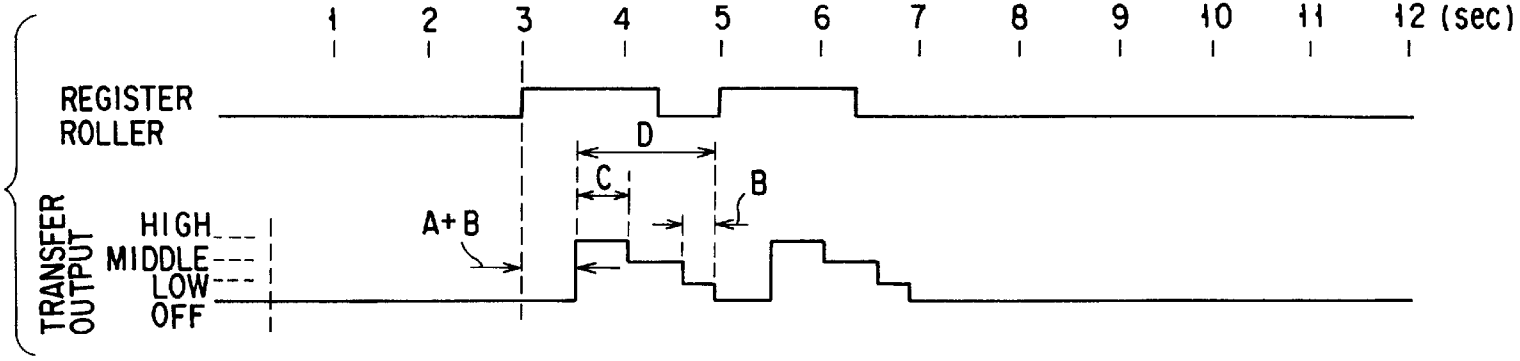
FIG. 7 is a timing chart for effecting an output control of a transfer charger.

With reference to FIGS. 1 and 7, an explanation will be given in more detail below about the switching timing of the transfer output on the present embodiment. FIG. 7 shows a timing chart at a time of switching the transfer output of the transfer charger 56. FIG. 1 shows a positionally relation of respective constituent elements for deciding the switching timings of the transfer outputs. The "separation" output control by the separation charger 57 is done, by the trailing edge of the sheet, in the same way as the transfer output, and, here, any detailed explanation on the switching control of the "separation" output is omitted below.

In FIGS. 1 and 7, A represents a time taken for the sheet to be conveyed from a nip position of the register roller pair 65 to the forward end 75*a* of the transfer guide 75; B, a time taken for the sheet to be conveyed from the forward end 75*a* of the transfer guide 75 to the image transfer point 62; C, a time taken for the sheet to be conveyed from the image transfer point 62 to the angled area 76*a* of the separation support 76; and D, a time taken for the transfer output to be given by the transfer charger 56.

When a print key of the operation panel, not shown, is depressed and the sheet P is fed from the sheet cassette, not shown the controller 80 obtains size data of the sheet P on the basis of an output from the cassette sensor 84 and obtains a sheet passing timing via the pre-register roller switch 66. The controller 80 calculates the trailing edge of the sheet P on the basis of the sheet size data and sheet passing timing. In other words, the controller calculates a transfer output time D.

And the sheet conveying times A and B are calculated and the register roller pair 65 serving as a reference of the transfer output switching timing is turned ON. Then when a time A+B taken from the resist roller pair 65 to the image transfer point 62 passes, the transfer output of the transfer charger 56 goes "High" and is turned ON. At this time, it is predicted that the leading edge of the sheet P will sag under its own weight.

Then at a passage of the time C, that is, when the leading edge of the sheet P is passed over to the separation supporter 76, the transfer output of the transfer charger 56 is switched to a Middle level.

At a passage of a time (D−B−C), that is, when the trailing edge of the sheet P passes through the forward end 75*a* of the transfer guide 75, the transfer output of the transfer charger 56 is switched from a Middle to a Low level. At this time, the separation charger 57 is switched to a Low level.

And after the passage of time B after the transfer output of the transfer charger 56 is switched to the Low, that is, immediately after the trailing edge of the sheet P is passed through the image transfer point 62, the r transfer output of the transfer charger 56 is rendered OFF.

When the pre-register roller switch 66 detects the leading edge of a subsequent sheet P, then the above-mentioned operation is repeated.

If, for manual sheet feeding, the print key on the operation panel, not shown, is depressed, the register roller pair 65 is turned ON, the transfer output to the transfer charger 56 goes High (at A+B) and is turned ON. At a time point when the pre-register roller switch 66 serving as a timing reference is turned OFF, the transfer output time D is calculated with respect to the sheet P and the same control as set out above is done. Subsequently, the above-mentioned operation is performed each time the register roller pair 65 is turned ON.

According to the present invention, as set out above, the transfer output and separation output are switched in accordance with the conveying position of the sheet P, that is, of the leading edge portion, middle portion and trailing edge portion. By doing so it was possible to achieve a uniform transfer capability over the sheet P and create a better-quality image over the full length of the sheet P.

The present invention is not restricted to the above-mentioned embodiment and various changes or modifications of the present invention can be made without departing from the spirit and scope of the present invention.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

I claim:

1. An image forming apparatus comprising:

developing agent image forming means for forming a developing agent image on an image carrier;

conveying means for conveying a transfer material toward the image carrier;

detecting means for detecting a size of the transfer material conveyed by the conveying means;

transfer means arranged opposite the image carrier which applies transfer charges to the transfer material conveyed by the conveying means to transfer a developing agent image which is formed on the image carrier onto the transfer material, the transfer means applying a transfer charge of a first charge amount to a first area of the transfer material including a leading edge thereof, applying a transfer charge of a second charge amount smaller than the first charge amount to a second area of the transfer material following the first area, and applying a transfer charge of a third charge amount smaller than the second charge amount to a third area of the transfer material including a trailing edge thereof and following the second area of the transfer material; and control means for, on the basis of the result of detection by the detecting means, controlling a timing by which the switching of the transfer charges by the transfer means is performed.

2. An image forming apparatus as claimed in claim 1, further comprising separation means for separating the material from the image carrier by supplying a separation charge to the material with the developing agent image.

3. An image forming apparatus as claimed in claim 2, wherein the separation charge is changed at the time the transfer means applies the transfer charge of the third amount to the third area.

4. An image forming apparatus as claimed in claim 2, wherein the control means controls the separation charge simultaneously with the switching of the transfer charges.

5. An image forming apparatus as claimed in claim 1, further comprising a guide member for guiding the material in the conveying direction downstream of the transfer means to move the material nearer to the image carrier.

6. An image forming apparatus comprising:

developing agent image forming means for forming a developing agent image on an image carrier;

conveying means for conveying a transfer material past a transfer area vertically below the image carrier;

detecting means for detecting a size of the transfer material conveyed by the conveying means along a conveying direction;

transfer means arranged below the image carrier in an opposed relation through the transfer area, said transfer means applying a transfer charge to the transfer material conveyed through the transfer area to transfer the developing agent image formed on the image carrier to the transfer material, the transfer means applying a transfer charge of a first charge amount to a first area of the transfer material including a leading edge thereof, applying a transfer charge of a second charge amount smaller than the first charge amount to a second area of the transfer material following the first area and applying a transfer charge of a third charge amount smaller than the second charge amount to a third area of the transfer material including a trailing edge thereof following the second area of the transfer material;

first and second guide members, arranged adjacent to the transfer area on an upstream side and downstream side of the conveying direction of the transfer material, for guiding the transfer material in such a manner as to allow the transfer material which passes through the transfer area to be moved near the image carrier; and control means for, based on a result of detection by the detecting means, calculating a first timing at which the leading edge of the transfer material in the conveying direction arrives at the transfer area, a second timing at which the leading edge of the transfer material arrives at the second guide and a third timing at which the trailing edge of the transfer material in the conveying direction passes through the first guide; and for controlling the switching of the transfer charges by the transfer means to the first charge amount at the first timing, to the second charge amount at the second timing and to the third charge amount at the third timing.

7. An image forming apparatus as claimed in claim 6, further comprising separation means for separating the material from the image carrier by supplying a separation charge to the material with the developing agent image.

8. An image forming apparatus as claimed in claim 7, wherein the separation charge is changed at the time the transfer means applies the transfer charge of the third amount to the third area.

9. An image forming apparatus as claimed in claim 7, wherein the control means controls the separation charge simultaneously with the switching of the transfer charges.

10. An image forming apparatus comprising:

a drum having a surface;

a sensor for detecting a size of a transfer material;

a transfer guide upstream from the drum, wherein the transfer guide conveys the transfer material toward the drum;

a separation supporter downstream from the transfer guide and receiving the transfer material from the transfer guide;

a transfer charger, wherein an output of the transfer charger applies a transfer charge of a first charge amount to a first area of the transfer material including a leading edge thereof, applies a transfer charge of a second amount smaller than the first charge amount to a second area of the transfer material following the first area, and applies a transfer charge of a third charge amount smaller than the second charge amount to a third area of the transfer material including a trailing edge thereof and following the second area of the transfer material; and a controller that controls the transfer charger based on the size of the transfer material.

11. An image forming apparatus as claimed in claim 10, further comprising a separation unit downstream of the transfer charger.

12. An image forming apparatus as claimed in claim 10, wherein the first charge amount is between 10 $\mu$A and 14 $\mu$A.

13. An image forming apparatus as claimed in claim 10, wherein the second charge amount is between 6 $\mu$A and 9 $\mu$A.

14. An image forming apparatus as claimed in claim 10, wherein the third charge amount is between 3 $\mu$A and 6 $\mu$A.

15. An image forming apparatus as claimed in claim 10, further comprising a cleaning unit downstream of the transfer charger.

* * * * *